US008832889B2

(12) United States Patent
Sportis et al.

(10) Patent No.: US 8,832,889 B2
(45) Date of Patent: Sep. 16, 2014

(54) FOUR-SIDED REVERSIBLE BEDDING ELEMENT

(76) Inventors: Fabienne Sportis, Paris (FR); Fabrice Requet, Paris (FR); Olivier Laurent, Gometz la Ville (FR)

( * ) Notice: Subject to any disclaimer, the term of this patent is extended or adjusted under 35 U.S.C. 154(b) by 3 days.

(21) Appl. No.: 14/003,383

(22) PCT Filed: Mar. 14, 2012

(86) PCT No.: PCT/EP2012/054470

§ 371 (c)(1),
(2), (4) Date: Sep. 20, 2013

(87) PCT Pub. No.: WO2012/123499

PCT Pub. Date: Sep. 20, 2012

(65) Prior Publication Data

US 2014/0013505 A1 Jan. 16, 2014

(30) Foreign Application Priority Data

Mar. 14, 2011 (FR) ..... 11 00758
Dec. 8, 2011 (FR) ..... 11 61321

(51) Int. Cl.

| | |
|---|---|
| ***A47C 27/15*** | (2006.01) |
| ***A47C 27/14*** | (2006.01) |
| ***A47C 19/02*** | (2006.01) |
| ***A47D 15/00*** | (2006.01) |
| ***A47C 27/20*** | (2006.01) |

(52) U.S. Cl.

CPC ..... *A47C 27/20* (2013.01); *A47C 19/02* (2013.01); *A47C 27/148* (2013.01); *A47D 15/001* (2013.01); *A47C 27/15* (2013.01); *A47C 27/144* (2013.01)

USPC ..... 5/727; 5/728; 5/740

(58) Field of Classification Search

USPC ..... 5/727, 728, 740, 655.9, 953, 722, 723, 5/691, 690

See application file for complete search history.

(56) References Cited

U.S. PATENT DOCUMENTS

| | | | | | |
|---|---|---|---|---|---|
| 2,835,313 | A | * | 5/1958 | Dodge | 5/740 |
| 3,110,042 | A | * | 11/1963 | Slemmons | 5/728 |
| 3,210,781 | A | * | 10/1965 | Pollock | 5/718 |
| 3,222,697 | A | * | 12/1965 | Scheermesser | 428/160 |
| 3,521,311 | A | * | 7/1970 | Cohen | 5/740 |
| 3,534,417 | A | * | 10/1970 | Boyles | 5/728 |

(Continued)

FOREIGN PATENT DOCUMENTS

| | | |
|---|---|---|
| DE | 1 709 027 U | 10/1955 |
| DE | 33 21 720 A1 | 12/1984 |

(Continued)

*Primary Examiner* — Robert G Santos
(74) *Attorney, Agent, or Firm* — Sughrue Mion, PLLC

(57) ABSTRACT

A bedding element including a first large principal face opposite a second large principal face and divided lengthwise into portions that define. on the first large principal face, first successive receiving areas (A1 to A7) of which a first succession (A1 to A7) defines a first resting area and of which a second succession (A7 to A1) opposite the first defines a second resting area; and on the second large principal face, second successive receiving areas (B1 to B7) of which a first succession (B1 to B7) defines a third resting area and of which a second succession (B7 to B1) opposite the first defines a fourth resting area. The portions of the bedding element that define these receiving areas have differentiated mechanical characteristics so that the four resting areas have four different receiving profiles.

9 Claims, 4 Drawing Sheets

(56) References Cited

U.S. PATENT DOCUMENTS

| | | | | | |
|---|---|---|---|---|---|
| 3,846,857 | A * | 11/1974 | Weinstock | 5/727 |
| 3,885,258 | A * | 5/1975 | Regan | 5/727 |
| 3,939,508 | A * | 2/1976 | Hall et al. | 5/727 |
| 4,047,254 | A * | 9/1977 | Hamasu | 5/740 |
| 4,053,957 | A * | 10/1977 | Regan | 5/727 |
| 4,161,045 | A * | 7/1979 | Regan | 5/727 |
| 4,498,477 | A * | 2/1985 | Masuda et al. | 607/115 |
| 5,179,742 | A * | 1/1993 | Oberle | 5/727 |
| 5,604,021 | A * | 2/1997 | Wagner | 428/218 |
| 5,643,139 | A * | 7/1997 | Stout et al. | 482/14 |
| 5,671,492 | A * | 9/1997 | Simon | 5/722 |
| 5,953,779 | A * | 9/1999 | Schwartz | 5/722 |
| 5,960,496 | A * | 10/1999 | Boyd | 5/722 |
| 6,052,851 | A * | 4/2000 | Kohnle | 5/690 |
| 6,061,856 | A * | 5/2000 | Hoffmann | 5/728 |
| 6,085,373 | A * | 7/2000 | Montana | 5/727 |
| 6,223,371 | B1 * | 5/2001 | Antinori et al. | 5/727 |
| 6,256,821 | B1 * | 7/2001 | Boyd | 5/727 |
| 6,311,351 | B1 * | 11/2001 | Murphy | 5/727 |
| 6,988,287 | B1 * | 1/2006 | Swartzburg | 5/691 |
| 7,155,765 | B2 * | 1/2007 | Fogg | 5/691 |
| 7,191,483 | B2 * | 3/2007 | Hochschild | 5/740 |
| 7,386,903 | B2 * | 6/2008 | Hochschild | 5/740 |
| 7,444,702 | B2 * | 11/2008 | Fogg | 5/740 |
| 7,559,106 | B1 * | 7/2009 | Crousore et al. | 5/740 |
| 7,707,670 | B2 * | 5/2010 | Fogg | 5/691 |
| 8,196,241 | B2 * | 6/2012 | Balonick et al. | 5/740 |
| 2005/0076446 | A1 * | 4/2005 | Fogg | 5/690 |
| 2006/0272098 | A1 * | 12/2006 | Hochschild | 5/727 |
| 2007/0022540 | A1 * | 2/2007 | Hochschild | 5/727 |
| 2007/0094803 | A1 * | 5/2007 | Fogg | 5/691 |
| 2009/0056028 | A1 * | 3/2009 | Fogg | 5/690 |
| 2009/0222996 | A1 * | 9/2009 | Balonick et al. | 5/730 |
| 2010/0264571 | A1 * | 10/2010 | Tarazona De La Asuncion | 267/141 |
| 2011/0083277 | A1 * | 4/2011 | Henson | 5/655.9 |
| 2014/0013505 | A1 * | 1/2014 | Sportis et al. | 5/400 |

FOREIGN PATENT DOCUMENTS

| | | | | | |
|---|---|---|---|---|---|
| DE | 19600435 | A1 * | 7/1997 | A47C 27/14 |
| DE | 103 39 555 | A1 | 6/2005 | |
| EP | 1 329 177 | A2 | 7/2003 | |
| EP | 1757210 | A2 * | 2/2007 | A47C 27/05 |
| FR | 2 563 420 | A1 | 10/1985 | |
| FR | 2 730 914 | A3 | 8/1996 | |
| GB | 2037155 | A * | 7/1980 | A47C 27/14 |
| GB | 2157163 | A * | 10/1985 | A47C 27/15 |

* cited by examiner

FOUR-SIDED REVERSIBLE BEDDING ELEMENT

CROSS REFERENCE TO RELATED APPLICATIONS

This application is a National Stage of International Application No. PCT/EP2012/054470, filed on Mar. 14, 2012, which claims priority from French Patent Application Nos. 11 00758, filed on Mar. 14, 2011 and 11 61321 filed on Dec. 8, 2011, the contents of all of which are incorporated herein by reference in their entirety.

The invention relates to the field of the necessities of life and notably sleeping equipment and bedding elements. The invention concerns more particularly although not exclusively a mattress subdivided into portions in the lengthwise direction to define diversified resting areas adapted to the morphology and the needs of a user.

A more specific object of the invention is a mattress intended for children and adults providing support for the user when using the mattress support, which can be adapted according to the morphology and/or the wishes of the sleeper.

TECHNOLOGICAL BACKGROUND OF THE INVENTION

Bedding elements in the form of conventional mattresses are produced in accordance with two very different techniques. Thus there exist mattresses including a metal internal structure, more generally referred to as "spring-interior mattresses", and mattresses including one or more blocks of foam, referred to as "foam mattresses".

However, because of their dimensions, such conventional mattresses are often heavy and difficult to transport. Moreover, stocking such mattresses proves to be extremely costly because to meet the requirements of their clientele a vendor must be able to have available a set of mattress designs of different sizes and with different characteristics.

Thus there is proposed in the document FR 2 563 420 a mattress made up of elementary spring elements articulated to each other by means of zips or hooks-and-eyes.

Now, zips or hooks-and-eyes can compromise the flatness of the mattress. Moreover, the presence of upstanding portions of zips or hooks-and-eyes can prove uncomfortable or disagreeable for a user.

The document FR 2 730 914 discloses a mattress formed of a plurality of blocks made from elastomer foam each having lateral edges and horizontal main surfaces. The lateral edges of the various blocks have cut-outs of complementary shape to enable the blocks to interengage in one another.

In the same way, the various blocks when assembled prove not to form a flat mattress with the result that a user may be troubled by the irregularity of the surface of the assembly.

Moreover, it proves necessary to assemble a large number of blocks to enable a mattress of respectable size to be obtained on which a user can stretch out.

Thus the document EP 1 329 177 describes a mattress including a non-deformable structure that comprises one or two receptacles. The two receptacles are then each intended to receive a synthetic material sub-mattress and the sub-mattresses can therefore be adapted to the needs of a user.

However, the structure receiving the sub-mattresses itself proves relatively bulky and heavy.

OBJECT OF THE INVENTION

An object of the invention is to propose a bedding element avoiding at least some of the aforementioned problems.

BRIEF DESCRIPTION OF THE INVENTION

With a view to achieving this object, there is proposed a bedding element including a first large principal face opposite a second large principal face, the bedding element being divided in the lengthwise direction into portions that define:

- on the first large principal face, first successive receiving areas of which a first succession defines a first resting area of the bedding element and of which a second succession that is the opposite of the first defines a second resting area of the bedding element;
- on the second large principal face, second successive receiving areas of which a first succession defines a third resting area of the bedding element and of which a second succession that is the opposite of the first defines a fourth resting area of the bedding element;

the portions of the bedding element that define these receiving areas having in accordance with the invention differentiated mechanical characteristics so that the four resting areas defined in this way have four different receiving profiles.

Here by resting area is meant the principal face on which the user stretches out, given the direction of use of the bedding element. There are therefore two resting areas per principal face, i.e. in total four resting areas.

Here by receiving profile is meant the series of mechanical characteristics of the successive receiving areas that constitute each resting area. The receiving density of the resting area may also be mentioned.

Accordingly, the same bedding element in accordance with the invention makes it possible to offer four resting areas with different receiving profiles. This bedding element can therefore be used in four different ways. Thus a bedding element of this kind may be referred to as reversible on "four sides".

Each user can therefore choose the resting area best suited to their morphology or their needs. Consequently, the same bedding element in accordance with the invention provides rest and complete relaxation for a large number of users. The different receiving profiles make it possible for a user to be sure that at least one of the resting areas will be suited to their morphology, which guarantees them a relaxed feeling which is the basis for restful sleep.

BRIEF DESCRIPTION OF THE DRAWINGS

The invention will be better understood in the light of the following description of one nonlimiting embodiment of the invention given with reference to the appended figures, in which:

FIG. 2*bis* is a diagram showing the four receiving profiles of the bedding element from FIGS. 1 and 2;

FIG. 3*bis* is a diagrammatic perspective view of a bedding element in accordance with another variant of the first embodiment of the invention;

DETAILED DESCRIPTION OF THE INVENTION

Figure 1:
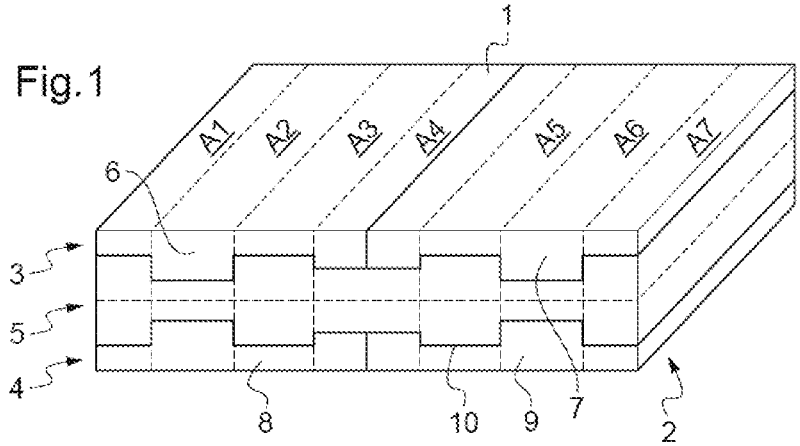
FIG. 1 is a diagrammatic perspective view of a bedding element in accordance with a first embodiment of the invention.
Figure 2:
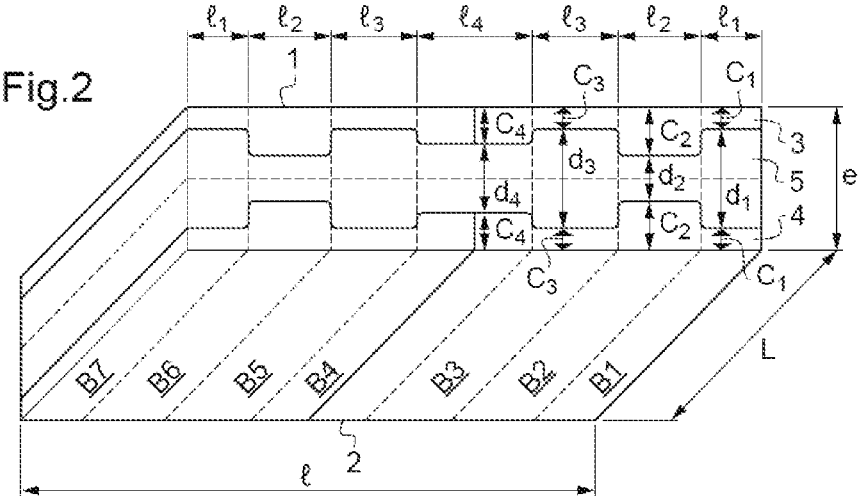
FIG. 2 is a more detailed perspective view of the bedding element shown in FIG. 1.
Figure 2:
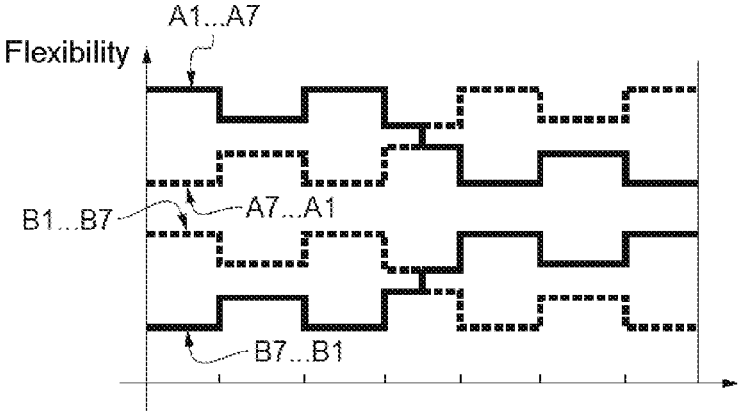

Referring to FIGS. 1 and 2, in accordance with a first embodiment of the invention, the mattress includes a first large principal face 1 opposite a second large principal face 2. Here the mattress is divided into seven portions (the divisions are represented in dashed outline) in the lengthwise direction, which define:

- on the first large principal face 1, successive receiving areas A1, A2, A3, A4, A5, A6, A7 of which a succession A1 to A7 defines a first resting area and of which an opposite succession A7 to A1 defines a second resting area;
- on the second large principal face, successive receiving areas B1, B2, B3, B4, B5, B6, B7 (as can be seen better in FIG. 2) of which a succession B1 to B7 defines a third resting area and an opposite succession B7 to B1 defines a fourth resting area.

Accordingly, when the user uses the first resting area, the receiving area A1 receives the head, the receiving area A2 receives the shoulders, the receiving area A3 receives the lumbar vertebrae and the receiving area A4 receives the pelvis of the user. The receiving areas A5 to A7 receive the rest of the body of the user.

If the user uses the second resting area, the receiving area A7 receives the head, the receiving area A6 receives the shoulders, the receiving area A5 receives the lumbar vertebrae and the receiving area A4 receives the pelvis of the user. The receiving areas A3 to A1 receive the rest of the body of the user.

The same goes of course for the resting areas B1 to B7 and B7 to B1.

It is therefore possible to use the mattress four ways around as a function of the resting area that the user uses, so that the mattress may be referred to as four-sided reversible.

In accordance with the invention, the four resting areas have different receiving profiles, a user being easily able to find a resting area suited to their morphology and their needs.

To obtain these different receiving profiles, the mattress here includes:

- a first external layer 3 forming the first large principal face 1, the first external layer 3 here being constituted of a first block 6 and a second block 7 joined in a joining area in the middle of the receiving area A4 intended to receive the pelvis of a user,
- a second external layer 4 forming the second large principal face 2, the second external layer 4 here being constituted of a first block 8 and a second block 9 joined in a joining area in the middle of the receiving area B4 intended to receive the pelvis of a user, and
- an intermediate layer 5 between the two external layers and here formed of a single block.

The two blocks forming each of the external layers 3, 4, are assembled by being glued or bonded to each other, for example.

In accordance with the embodiment shown here, the intermediate material layer 5 has a non-uniform thickness. Thus the intermediate material layer 5 includes prismatic projections 10 (only one of which is referenced in FIG. 1) that enter indentations of the same shape in the external layers 3, 4. The projections 10 are arranged so that the thickness of the intermediate material layer 5 varies from one portion of the mattress to another.

Moreover, the various blocks constituting the layers are preferably made from various materials which therefore confer particular mechanical characteristics on the various receiving areas, for example in terms of springiness, flexibility, firmness, etc.

Accordingly, the blocks 6, 7, 8, 9 are therefore produced in elastomer foams with different flexibilities, for example. These differences in mechanical characteristics, associated with the geometry of the layers of the mattress, produce the receiving profiles represented in FIG. 2*bis*, which as it happens are flexibility profiles here, which are very different from one another.

The intermediate material layer 5 is preferably made from a material much firmer than the materials of the external layers. In this way, a user will feel less firmly supported by the intermediate layer 5 thanks to a damping effect of the external layers.

Referring to FIG. 2, in one particular embodiment, the mattress has the following illustrative dimensions:

- a length $\underline{l}$ of 200 centimeters;
- a width L of 90 centimeters;
- a thickness $\underline{e}$ of 20 centimeters.

The receiving areas have the following illustrative dimensions:

- the receiving areas A1, A7, B1, B7 have a length $l_1$ of 20 centimeters;
- the receiving areas A2, A6, B2, B6 have a length $l_2$ of 30 centimeters;
- the receiving areas A3, A5, B3, B5 have a length $l_3$ of 30 centimeters;
- the receiving areas A4 and B4 have a length $l_4$ of 40 centimeters.

The layers have the following illustrative dimensions:

- in the receiving areas A1, A7, B1, B7, the intermediate layer has a thickness d1 of 14 centimeters and the external layers each have a thickness c1 of 3 centimeters;
- in the receiving areas A2, A6, B2, B6, the intermediate layer has a thickness d1 of 6 centimeters and the external layers each have a thickness c1 of 7 centimeters;
- in the receiving areas A3, A5, B3, B5, the intermediate layer has a thickness d1 of 14 centimeters and the external layers each have a thickness c1 of 3 centimeters;
- in the receiving areas A4 and B4, the intermediate layer has a thickness d1 of 10 centimeters and the external layers each have a thickness c1 of 5 centimeters.

Figure 3:
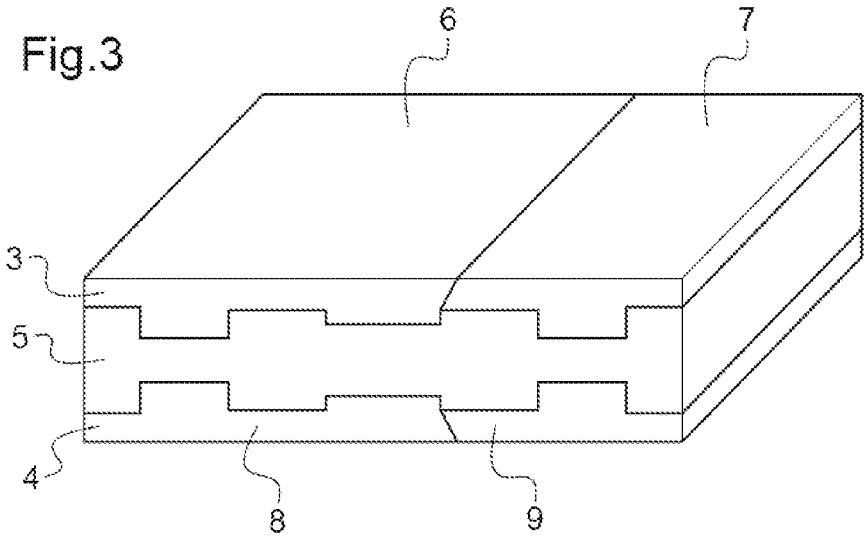
FIG. 3 is a diagrammatic perspective view of a bedding element in accordance with a variant of the first embodiment of the invention.
Figure 3:
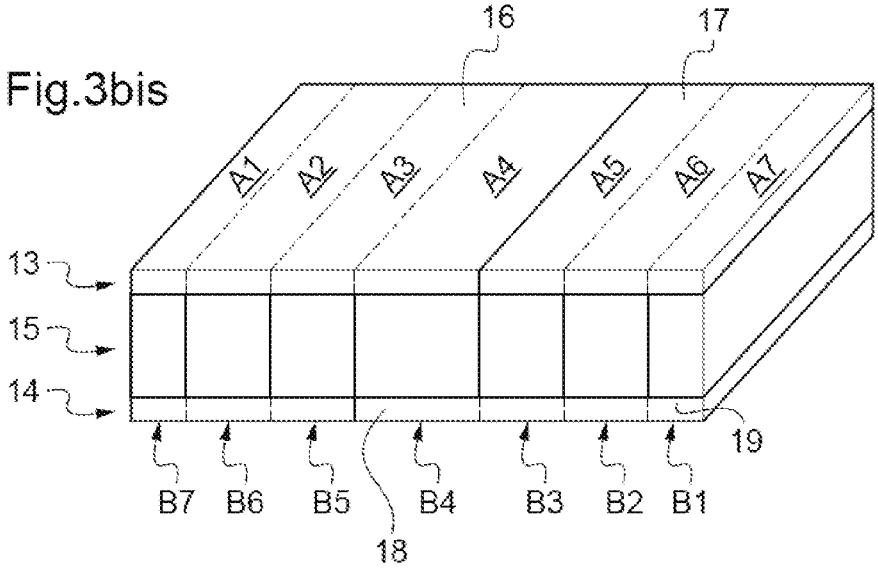

Referring to FIG. 3, in accordance with a variant of the first embodiment of the invention, the blocks 6, 7 of the first external layer 3 and the blocks 8, 9 of the second external layer 4 are arranged so that the joining areas between the blocks constituting the same layer are situated substantially at the boundary between two receiving areas, here the boundary between the receiving areas A4, A5 and B3, B4, respectively. Accordingly, the junction is no longer in the middle of a receiving area, which avoids the discontinuity in the receiving profile in the receiving areas A4 and B4, visible in FIG. 2*bis*, and improve the comfort of a user who then feels the joining area only slightly if at all.

Another variant of the first embodiment of the invention is described next with reference to FIG. 3*bis*.

Here the mattress includes:

a first external layer 13 forming the first large principal face 11, the first external layer 13 being constituted here of a first block 16 and a second block 17 joined in a joining area that here lies at the boundary between the receiving areas A4 and A5, a second external layer 14 forming the second large principal face 12, the second external layer 14 being constituted here of a first block 18 and a second block 19 joined in a joining area that here lies at the boundary between the receiving areas B4 and B5, and an intermediate layer 15 between the two external layers.

In accordance with the variant shown here, the intermediate material layer 15 has a uniform thickness and here is constituted of seven blocks, two consecutive blocks being joined in a joining area that itself lies at the boundary between two consecutive receiving areas.

The seven blocks of the intermediate layer 15 are made from various materials which therefore confer particular mechanical characteristics on the various receiving areas, for example in terms of elasticity, flexibility, firmness, etc. The intermediate material layer 15 is preferably constituted of a pocket containing the seven blocks, each block being formed by springs of different stiffness so that each block has a different stiffness.

These differences in mechanical characteristics produce receiving profiles that are very different from one another.

Figure 4:
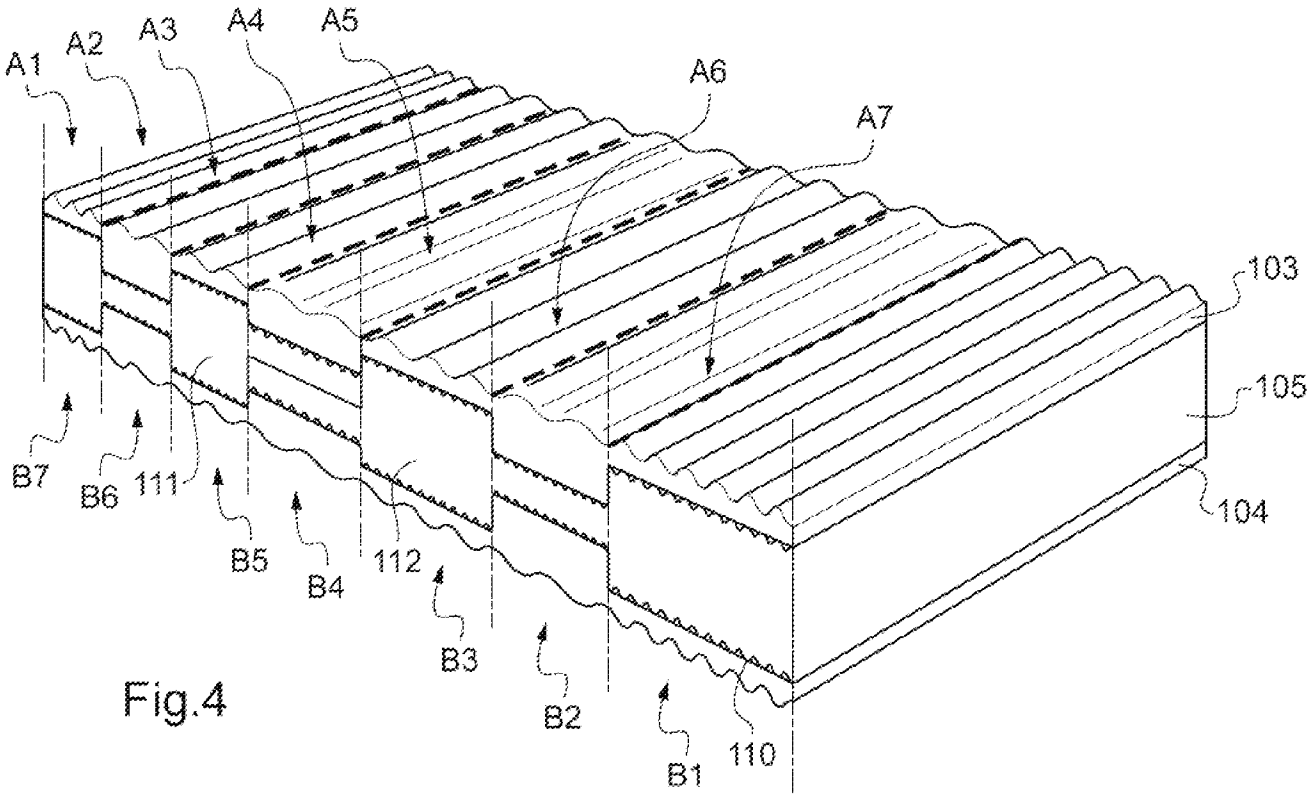
FIG. 4 is a diagrammatic perspective view of a bedding element in accordance with a second embodiment of the invention.

A second embodiment will now be described with reference to FIG. 4, elements common to the first embodiment bearing the same references increased by 100.

In this second embodiment, the first external layer 103 is in one piece. The second external layer 104 is also in one piece.

The intermediate material layer 105 on the other hand is constituted of a first block 111 and a second block 112, the two blocks being of symmetrical shape.

The first block 111 includes:

a first section under the receiving area A1;

a second section under the receiving area A2 that is thinner than the first section;

a third section under the receiving area A3 that is the same thickness as the first section;

a fourth section under the receiving area A4 that is half the thickness of the second section.

In a symmetrical manner, the second block 112 includes:

a first section under the receiving area A7 that is identical to the first section of the first block 111;

a second section under the receiving area A6 that is identical to the second section of the first block 111;

a third section under the receiving area A5 that is identical to the third section of the first block 111;

a fourth section under the receiving areas A4 that is the same thickness as the fourth section of the first block 111.

The two blocks are shaped so that when they are assembled the fourth section of the first block 111 overlaps the fourth section of the second block 112. The two blocks are assembled for example by being glued or bonded to each other.

Because of the variation of the thickness of their various sections, the two blocks of the intermediate material layer 105 include prismatic projections 110 (only one of which is referenced in FIG. 4) that cooperate with corresponding indentations in the external layers 103 and 104.

In one particular embodiment, the first external layer 103 is made here of a shape memory foam having a resilience R1, the second external layer 104 is made here of a shape memory form having a resilience R2, the first block 111 is formed of springs of stiffness k1 and the second block 112 is formed of springs of stiffness k2. It will be noted that each of the blocks 111 and 112 includes springs of different height according to the receiving area containing the springs.

The two blocks of the intermediate layer and the two external layers being made up of elements having different mechanical properties, the four resting areas therefore have different receiving profiles.

Here the blocks of the intermediate material layer 105 have corrugated faces while the facing faces of the external layers are plane. Spaces are therefore created between the intermediate layer 105 and the external layers 103, 104 when the mattress is formed. These spaces take the form of ducts extending the entire width of the mattress and enable better ventilation of the latter.

The exterior faces of the external layers 103, 104 forming the first principal face and the second principal face are preferably also corrugated. These corrugations also enable better ventilation of the mattress. Moreover, they make it possible to massage the user when they change position, notably if the mattress is used with an electric bed base.

The mattress in accordance with the invention therefore offers four different resting areas and thus four different comfort levels.

Figure 5:
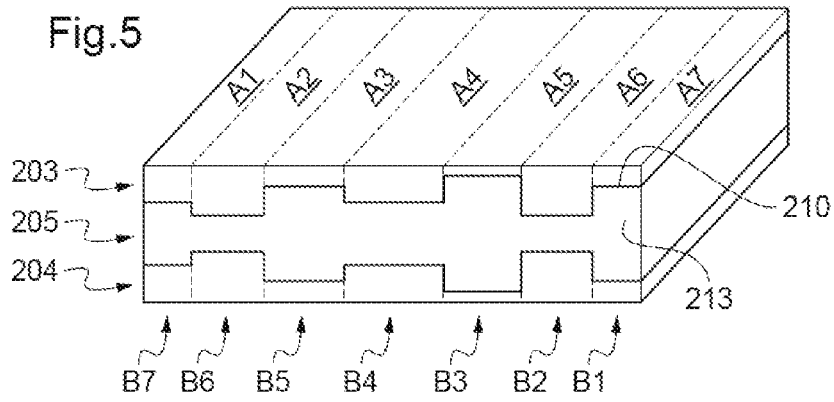
FIG. 5 is a diagrammatic perspective view of a bedding element in accordance with a third embodiment of the invention.

A third embodiment will be described next with reference to FIG. 5. Elements common with the first embodiment bear the same references increased by 200.

In this second embodiment, the first external layer 203 is in one piece. The second external layer 204 is also in one piece. The intermediate material layer 205 is also constituted of a single block 213. The first external layer 203 and the second external layer 204 are made of different materials.

The block 213 of the intermediate layer 205 here includes seven sections each lying under a different receiving area. At least two sections of the intermediate layer 205 have different thicknesses so that at least one of the sections of the block 213 lying under the receiving area A1 or A2 or A3 has a thickness different from one of the sections of the block 213 lying under the receiving area A5, A6 or A7. As a result, the block 213 will have an asymmetrical profile according to whether the succession A1 to A7 or the succession A7 to A1 is referred to. The block 213 will likewise have an asymmetrical profile according to whether the succession B1 to B7 or the succession B7 to B1 is referred to.

Because of the variation of the thickness of its various sections, the block 213 of the intermediate material layer 205 includes prismatic projections 210 (only one of which is referenced in FIG. 5) that cooperate with corresponding indentations in the external layers 203 and 204.

The two external layers 203 and 204 being made up of elements having different mechanical properties, and the intermediate layer 205 having an asymmetrical profile between the areas A1 to A3 and the areas A5 to A7, the four resting areas therefore have different receiving profiles.

The mattress in accordance with the invention therefore offers four different resting areas and thus four different comfort levels.

Of course, the invention is not limited to the embodiment described and which may be varied without departing from the scope of invention as defined by the claims.

In particular, the dimensions of the mattress could be very different from those cited. For example, the width of the mattress could vary between 70 and 200 centimeters. The thickness of the mattress will preferably vary between 15 and 35 centimeters. Each receiving area preferably has a length of about 30 centimeters.

The mattress can also be made to measure if a user has a particular morphology by adapting the materials and/or the dimensions to enable a different thrust distribution according to the morphological or pathological problems of the user.

Moreover, for a mattress of large size, for example 160 centimeters wide, a single mattress could be used or two identical mattresses in accordance with the invention joined together by an adhesive tape such as hook and loop fastener or a peripheral elastic band or with a common cover covering the two mattresses, the cover preferably being elastic. The two mattresses joined together in this way are placed in a fabric cover. In another embodiment, two different mattresses in accordance with the invention could be used and joined in the same way by an adhesive tape such as hook and loop fastener. The assembled mattress will therefore include a greater number of resting areas than one mattress in accordance with the invention on its own.

It is thus possible to produce multiple combinations as a function of the habits or desires of the user.

The external and intermediate layers could be made from flexible foam, compact foam, high-density polyurethane foam, shape-memory foam or latex or include one or more pockets receiving metal, plastic or foam springs or include one or more pockets receiving water or air, one or more pockets containing slats, etc. If springs are used, the diameter or the height of the springs could be varied so as to form receiving areas with different mechanical characteristics.

The mechanical characteristics of each receiving area conferred by the mechanical characteristics of the materials used and the geometry of the various layers could relate to a number of aspects, such as the resilience, flexibility, deformation time under load, etc.

Although the mattresses shown here comprise two external layers separated by an intermediate layer, the mattress could be made in any other way, provided that they define four resting areas with different receiving profiles. In particular, more than three layers could be used or the number of layers varied over the length of the mattress.

Figure 6:
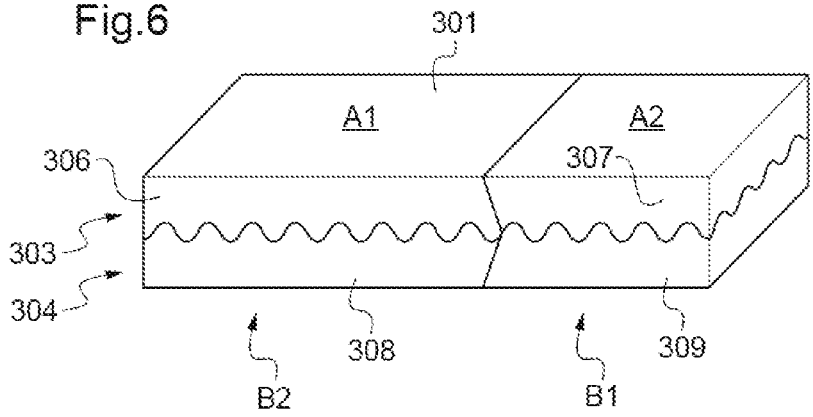
FIG. 6 is a diagrammatic perspective view of a bedding element in accordance with a fourth embodiment of the invention.

Accordingly, referring to FIG. 6, a mattress in accordance with the invention includes a first large principal face 301 opposite a second large principal face 302. Here the mattress is divided into two portions in the lengthwise direction which define:

- on the first large main face 301, successive receiving areas A1, A2 of which a succession A1 to A2 defines a first resting area and an opposite succession A2 to A1 defines a second resting area;
- on the second large main face, successive receiving areas B1, B2 of which a succession B1 to B2 defines a third resting area and an opposite succession B2 to B1 defines a fourth resting area.

In accordance with the invention, the four resting areas have different receiving profiles, a user being easily able to find a resting area suited to their morphology and their needs.

To obtain these different receiving profiles, the mattress here includes:

- a first external layer 303 forming the first large principal face 301, the first external layer 303 being constituted here of a first block 306 and a second block 307 joined in a joining area at the boundary between the receiving area A1 and the receiving area A2;
- a second external layer 304 forming the second large principal face 302, the second external layer 304 being constituted here of a first block 308 and a second block 309 joined in a joining area at the boundary between the receiving area B1 and the receiving area B2.

The two blocks forming each of the external layers 303, 304 are assembled for example by being glued or bonded to each other.

The various blocks constituting the external layers 303, 304 are made from various materials which therefore confer particular mechanical characteristics on the various receiving areas, for example in terms of elasticity, flexibility, firmness, etc.

These differences in mechanical characteristics produce four receiving profiles that are very different from one another.

Finally, although in the example shown each resting area is constituted of a succession of seven receiving areas, this number could of course be different. In particular, just two receiving areas could be defined on each of the principal faces of the mattress. Resting areas could also be produced with receiving profiles varying continuously from one receiving area to another.

The joining area of two blocks forming at least part of an external layer and/or of the intermediate layer could be in the middle of a receiving area. Such a joining area will preferably lie at the boundary of two consecutive receiving areas in order to improve the comfort of a user. Even more preferably, two consecutive blocks will not form a joining area perpendicular to the large principal faces but will be cut so as to form a joining area inclined relative to a perpendicular to the large principal faces (as shown in FIG. 3). In this way the user will be less aware of the joining area, which will further improve the comfort of the patient.

If the first external layer is formed of two blocks and the second external layer is also formed of two blocks, the joining area formed by the two blocks of the first external layer could lie in the same plane as the joining area formed by the two blocks of the second external layer. The joining area formed by the two blocks of the first external layer will preferably lie in a different plane than the joining area formed by the two blocks of the second external layer (as shown in FIG. 3*bis*). Thus the two joining areas will be offset, which will make the mattress as a whole stronger.

Although the bedding element described here is a mattress, the bedding element could be different. Thus the bedding element could be a mattress topper or a bed base. For example, in the various embodiments and variants described, the mattress could be sufficiently thin to be used as a mattress topper. The mattress topper will preferably have a thickness between 8 and 15 centimeters. For example, in the various embodiments and variants described, the mattress could be made thick enough and consist of materials firm enough to be used as a bed base, a traditional mattress or a mattress in accordance with the invention then covering said bed base.

Figure 7:
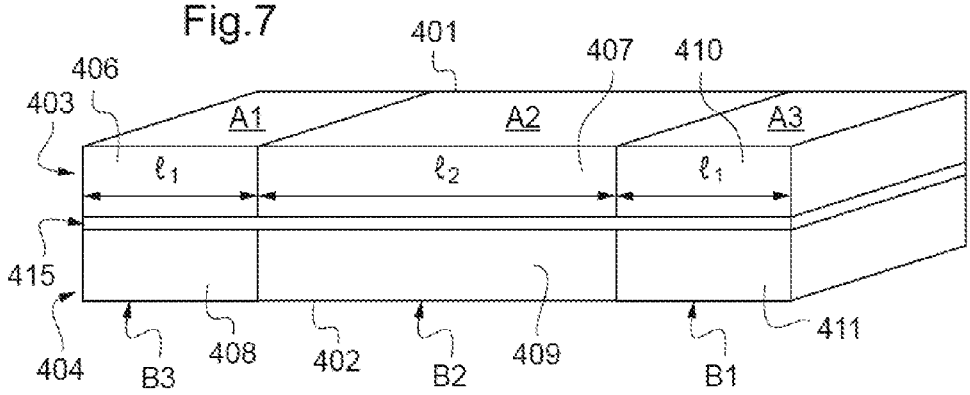
FIG. 7 is a diagrammatic perspective view of a bedding element in accordance with a fifth embodiment of the invention.

Accordingly, FIG. 7 shows a bed base having a first large principal face 401 opposite a second large principal face 402. Here the bed base is divided into three portions in the lengthwise direction which define:

- on the first large principal face 401, successive receiving areas A1, A2, A3 of which a succession A1 to A3 defines a first resting area and of which an opposite succession A3 to A1 defines a second resting area;
- on the second large principal face, successive receiving areas B1 to B3 of which a succession B1 to B3 defines a third resting area and of which an opposite succession B3 to B1 defines a fourth resting area.

In accordance with the invention, the four resting areas have different receiving profiles, a user easily being able to find a resting area suited to their morphology and their needs.

To obtain these different receiving profiles, here the mattress includes:

a first external layer 403 forming the first large principal face 401, the first external layer 403 here being constituted of a first block 406 and a second block 407 joined in a first joining area at the boundary between the receiving area A1 and the receiving area A2 and a third block 410 which is joined to the second block 407 in a second joining area at the boundary between the receiving area A2 and the receiving area A3;

a second external layer 404 forming the second large principal face 402, the second external layer 404 here being constituted of a first block 408 and a second block 409 joined in a first joining area at the boundary between the receiving area B3 and the receiving area B2 and a third block 411 which is joined to the second block 409 at the boundary between the receiving area B2 and the receiving area B1; and an intermediate layer 415 between the two external layers.

The three blocks forming each of the external layers 403, 404 are assembled for example by being glued or bonded to one another.

The various blocks constituting the external layers 403, 404 are made from various materials which therefore confer particular mechanical characteristics on the various receiving areas, for example in terms of elasticity, flexibility, firmness, etc.

In accordance with one particular embodiment, the first block 406 of the first external layer 403 and the first block 408 of the second external layer 404 are made of flexible foam; the third block 410 of the first external layer 403 and the third block 411 of the second external layer 404 are made of firm foam; the second block 407 of the first layer 403 includes springs and the second block 409 of the second layer 404 includes a pocket receiving slats. The intermediate layer is preferably made of wood.

The diversity of materials produces four receiving profiles that are very different from one another.

In accordance with one particular embodiment, a frame surrounds the external layers and the intermediate layer to form a unitary assembly. The frame is made of wood, for example.

The mattress has the following illustrative dimensions:

a length l of 200 centimeters;

a width L of 90 centimeters;

a thickness e of 20 centimeters.

The receiving areas have the following illustrative dimensions:

the receiving areas A1, A3, B1, B3 have a length $l_2$ of 50 centimeters;

the receiving areas A2 and B2 have a length $l_2$ of 100 centimeters.

The external layers each have a thickness of ten centimeters over their entire length.

The invention claimed is:

1. A bedding element including a first large principal face opposite a second large principal face, the bedding element being divided in the lengthwise direction into portions that define:

on the first large principal face, first successive receiving areas (A1 to A7) of which a first succession (A1 to A7) defines a first resting area of the bedding element and of which a second succession (A7 to A1) that is the opposite of the first defines a second resting area of the bedding element;

on the second large principal face, second successive receiving areas (B1 to B7) of which a first succession (B1 to B7) defines a third resting area of the bedding element and of which a second succession (B7 to B1) that is the opposite of the first defines a fourth resting area of the bedding element;

the portions of the bedding element that define these receiving areas having in accordance with the invention differentiated mechanical characteristics so that the four resting areas defined in this way have four different receiving profiles, wherein the element includes two external layers (3, 4; 13, 14; 103, 104; 203, 204) separated by an intermediate layer (5; 15; 105; 205), wherein the external layers (103, 104) are in one piece and the intermediate layer (105) is constituted of at least two blocks juxtaposed in the lengthwise direction.

2. The element as claimed in claim 1, wherein the intermediate layer (105) is constituted of two blocks.

3. The element as claimed in claim 2, wherein the two blocks (111; 112) of the intermediate layer are the same shape.

4. The element as claimed in claim 3, wherein the two blocks (111; 112) have overlapping end parts.

5. The element as claimed in claim 1, wherein the portions of the bedding element that define the receiving areas are made of flexible foam, compact foam, high-density polyurethane foam, shape memory foam or latex or include one or more pockets receiving metal or plastic or foam springs or include one or more pockets receiving water or air.

6. The element as claimed in claim 1, adapted to form a mattress.

7. The element as claimed in claim 1, adapted to form a mattress topper.

8. The element as claimed in claim 1, adapted to form a bed base.

9. A double mattress including two elements as claimed in claim 6 joined together by a common cover.

* * * * *